US008006427B2

(12) United States Patent
Blevins et al.

(10) Patent No.: US 8,006,427 B2
(45) Date of Patent: Aug. 30, 2011

(54) BORESIGHTING AND POINTING ACCURACY DETERMINATION OF GUN SYSTEMS

(75) Inventors: William M Blevins, Albuquerque, NM (US); Scott G Fischer, Rio Rancho, NM (US)

(73) Assignee: Honeywell International Inc., Morristown, NJ (US)

( * ) Notice: Subject to any disclaimer, the term of this patent is extended or adjusted under 35 U.S.C. 154(b) by 219 days.

(21) Appl. No.: 12/181,671

(22) Filed: Jul. 29, 2008

(65) Prior Publication Data

US 2011/0179689 A1 Jul. 28, 2011

(51) Int. Cl.
*F41G 1/35* (2006.01)
*F41G 3/00* (2006.01)
*G01S 17/02* (2006.01)

(52) U.S. Cl. ..... 42/115; 89/41.17; 434/19

(58) Field of Classification Search ..... 42/114, 42/115; 89/41.06, 41.09, 41.16, 41.17, 41.19, 89/200, 202, 203; 434/19, 21, 22
See application file for complete search history.

(56) References Cited

U.S. PATENT DOCUMENTS

| | | | | |
|---|---|---|---|---|
| 3,612,949 | A | 10/1971 | Becraft et al. | |
| 3,734,627 | A | 5/1973 | Edwards | |
| 3,792,535 | A | 2/1974 | Marshall et al. | |
| 3,816,000 | A | 6/1974 | Fiedler | |
| 3,891,323 | A * | 6/1975 | Ryan et al. | 356/154 |
| 4,015,258 | A * | 3/1977 | Smith et al. | 342/54 |
| 4,232,449 | A | 11/1980 | Linenberger | |
| 4,306,806 | A * | 12/1981 | Barron | 356/138 |
| 4,383,474 | A | 5/1983 | Paurus et al. | |
| 4,606,256 | A | 8/1986 | De'Ath | |
| 4,665,795 | A | 5/1987 | Carbonneau et al. | |
| 4,878,752 | A | 11/1989 | Bramley | |
| 4,879,814 | A | 11/1989 | Wallace et al. | |
| 4,885,977 | A | 12/1989 | Kirson et al. | |
| 4,917,490 | A * | 4/1990 | Schaffer et al. | 356/152.1 |
| 5,005,973 | A | 4/1991 | Mimmack et al. | |

(Continued)

FOREIGN PATENT DOCUMENTS

DE 20 13 166 A1 10/1971

OTHER PUBLICATIONS

D.H. Titterton and J.L. Weston, Strapdown Inertial Navigation Technology, Revised Second Edition, American Institute of Aeronautics and Astronautics (AIAA), 2004, pp. 287-288.

(Continued)

*Primary Examiner* — Bret Hayes
(74) *Attorney, Agent, or Firm* — Shumaker & Sieffert, P.A.

(57) ABSTRACT

A boresight apparatus and methods for use of same with a gun system are provided. The gun system includes a gun tube and a pointing device. The boresight apparatus is installed on an outside surface of the gun tube. Once the gun tube is adjusted to a desired gun-tube orientation, the boresight apparatus determines the gun-tube orientation, including an azimuth, an elevation, and a roll of the gun tube. The pointing device determines a pointing-device orientation at the desired angle. The gun system may be boresighted by adjusting the pointing device based on the gun-tube orientation. The pointing accuracy performance of the gun system may be determined based on offsets between the gun-tube orientation and the pointing-device orientation. The boresight may determine an azimuth using optical technologies, such as lasers, with a precision survey or using north-finding techniques with gyroscopes.

21 Claims, 9 Drawing Sheets

U.S. PATENT DOCUMENTS

| | | | | |
|---|---|---|---|---|
| 5,052,800 | A | 10/1991 | Mimmack et al. | |
| 5,171,933 | A | 12/1992 | Eldering | |
| 5,194,007 | A | 3/1993 | Marshall et al. | |
| 5,197,691 | A * | 3/1993 | Amon et al. | 244/3.13 |
| 5,365,669 | A | 11/1994 | Rustick et al. | |
| 5,410,815 | A | 5/1995 | Parikh et al. | |
| 5,413,028 | A | 5/1995 | Ng et al. | |
| 5,476,385 | A | 12/1995 | Parikh et al. | |
| 5,586,887 | A * | 12/1996 | McNelis et al. | 434/20 |
| 5,590,486 | A | 1/1997 | Moore | |
| 5,686,690 | A | 11/1997 | Lougheed et al. | |
| 6,061,918 | A | 5/2000 | Schnell | |
| 6,139,323 | A * | 10/2000 | Christians et al. | 434/16 |
| 6,237,236 | B1 | 5/2001 | Schnell | |
| 6,292,258 | B1 | 9/2001 | D'Alessandro et al. | |
| 6,386,879 | B1 | 5/2002 | Varshneya et al. | |
| 6,421,947 | B1 | 7/2002 | Fuller | |
| 6,596,976 | B2 | 7/2003 | Lin et al. | |
| 6,741,364 | B2 | 5/2004 | Lange et al. | |
| 6,807,740 | B2 | 10/2004 | Reed et al. | |
| 6,973,865 | B1 | 12/2005 | Duselis et al. | |
| 2003/0183070 | A1 | 10/2003 | Schneider | |
| 2007/0009860 | A1 | 1/2007 | Young | |
| 2007/0234627 | A1 | 10/2007 | Scherpf | |
| 2007/0238073 | A1 * | 10/2007 | Portoghese et al. | 434/21 |

OTHER PUBLICATIONS

European Search Report of corresponding EP Application No. 091661603, mailed Nov. 5, 2009, 3 pages.

European Examination Report from corresponding European Application No. 09 166 160, mailed Nov. 19, 2009, 3 pages.

* cited by examiner

BORESIGHTING AND POINTING ACCURACY DETERMINATION OF GUN SYSTEMS

FIELD OF THE INVENTION

This invention generally relates to the aiming of weapons, and more specifically to boresighting a pointing device to the gun tube of a gun system and determining the pointing performance of the gun system.

BACKGROUND

Modern gun systems consist of a gun tube and a "pointing device" that orients the gun tube in three dimensional space, allowing the gun tube to be aimed in a desired direction. FIGS. 1A, 1B, and 1C, are block diagrams of a side view, a top view, and a front view respectively, of a modern gun system 100.

FIG. 1A shows the gun system 100 with a gun tube 102 having a muzzle 104, a breech 106, a projectile 108, a firing mechanism 110, and a pointing device 112. The gun system 100 may be used to fire one or more projectiles, such as the projectile 108. A soldier or other user of the gun system 100 may insert the projectile 108 into the firing mechanism 110, typically via the breech 106 of the gun tube 102, in the case of breech loaded weapons, or into the muzzle 104 in the case of muzzle loaded weapons (such as mortars). The soldier may aim the gun in a desired direction using the pointing device 112. The soldier may fire the gun system 100 causing the projectile 108 to leave the gun system 100 via the muzzle 104 to travel on a trajectory. After traveling on a trajectory, the projectile 108 impacts at an impact location.

The term "boresighting", as used herein, is the procedure of aligning a pointing device of a gun system with the gun tube to a desired degree of accuracy and precision. Boresighting typically is performed both to initially establish alignment between the pointing device and the gun tube and periodically thereafter to ensure the pointing device is within its specified design performance.

Traditionally, both artillery and mortar weapons are boresighted using the Distant Aiming Point technique. This technique involves pointing the gun tube at some distant object by some independent means (actually sighting through the gun bore or employing some other device). Then, an aiming system, such as an optical sight or an electronic pointing device, is aimed at the same distant object. The "distant object" requirement reduces parallax errors that arise because the aiming system and gun tube do not share the same line of sight.

The orientation of the gun system 100 in three dimensional space may be specified in terms of three angles: an "elevation", an "azimuth", and a "roll". The elevation of a gun system is the angle between a horizontal plane having the gravity vector as a surface normal and an axis of a gun tube of the gun system. FIG. 1A shows an elevation 120 of E° for the gun system 100. FIG. 1A depicts the elevation 120 as a dashed line indicating the angle between a horizontal plane 122 and a gun-tube axis 124 of the gun tube 102 of the gun system 100. The elevation may be expressed in angular units such as degrees, radians, or as a quadrant elevation (QE). The QE may be expressed in terms of any units of angular measure, such as degrees, radians, or "mils". (There are 6,400 mils of arc in a circle; for example, a QE of 800 mils corresponds to a 45° angle.)

The azimuth indicates a direction of fire for the weapon system (i.e., the direction of the gun-tube axis 124) expressed as an angle from a reference direction, such as true north measured in the horizontal plane 122. FIG. 1B indicates an azimuth 140 of A°. FIG. 1B depicts the azimuth 140 as a dashed line, indicated with respect to a reference direction 130 and a direction of a gun tube 124. The azimuth may be expressed in terms of any units of angular measure, such as degrees, radians, or mils. This component of gun-tube orientation may be referred to as "deflection", which is an angle measured with respect to an arbitrary reference direction having a known relationship to a global reference direction such as true north.

The roll indicates an angle of rotation about the gun-tube axis 124 of the gun tube 102. FIG. 1C shows a FIG. 1C shows a cross-section of the gun tube 102 in a grey color with a roll 150 of R°, as well as an inner diameter (ID) 160 of the gun tube, an outer diameter (OD) 170, and a vertical centerline 180 of the gun tube. As shown on FIG. 1C, the inner diameter 160 is the diameter of the gun tube bore and the outer diameter 170 is the diameter of the gun tube 102. The vertical centerline 180 is defined to be the tube diameter that lies in the plane that also contains the gravity vector and the gun-tube axis 124. Typically, the roll and the elevation are defined with respect to a gravity vector pointing toward the center of the earth. However, the azimuth is typically defined with respect to a geodetic grid and a horizontal plane specified by the gravity vector.

As modern gun tubes, such as the gun tube 102, are typically symmetric about the gun-tube axis 124, the roll component of tube orientation may or may not be specified as part of the target of the gun system 100. However, some roll component is typically assigned for the processes of both boresighting a gun system 100 and the subsequent determination of the pointing accuracy of the pointing device 112. A roll component is typically assigned because roll in one frame-of-reference (e.g., the gun tube 102) affects the azimuth and elevation in a second frame-of-reference (e.g., the pointing device 112).

SUMMARY

Embodiments of the present application include methods and apparatus for boresighting a gun system and for characterizing the performance of previously boresighted systems.

A first embodiment of the invention provides a boresight apparatus for a gun system. The gun system includes a gun tube and a pointing device. The boresight comprises a mount and one or more angle-measurement devices. The mount is configured to attach the boresight to an outside surface of the gun tube. The one or more angle-measurement devices are attached to the mount and configured to determine at least one directional angle of the gun tube.

A second embodiment of the invention provides a method for boresighting a gun system. The gun system includes a pointing device and a gun tube. The boresight is installed on an outside surface of a gun tube. The gun tube is adjusted to a desired gun-tube orientation. A gun-tube orientation is determined using the boresight. The gun system is boresighted based on the gun-tube orientation.

A third embodiment of the invention provides a method of determining pointing accuracy of a gun system. The gun system includes a pointing device and a gun tube. The boresight is installed on an outside surface of a gun tube. The gun tube is adjusted to a desired gun-tube orientation. A gun-tube orientation is determined using the boresight. A pointing-device orientation is determined using the pointing device. Offsets are determined between the gun-tube orientation and the pointing-device orientation. The offsets are compared to a pointing-accuracy-performance specification. Responsive to the offsets being less than or equal to the pointing-accuracy-performance specification, a determination is made that the pointing accuracy of the gun system meets performance requirements.

BRIEF DESCRIPTION OF THE DRAWINGS

Various examples of embodiments are described herein with reference to the following drawings, wherein like numerals denote like entities, in which.

DETAILED DESCRIPTION

Figure 1A:
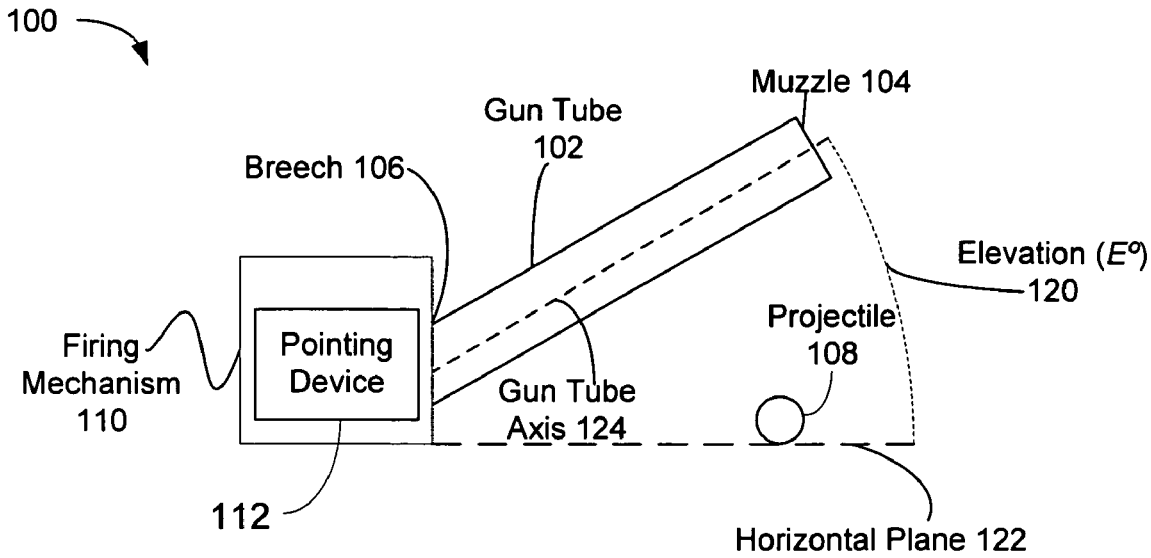
Figure 1A (Prior Art)
FIGS. 1A, 1B, and 1C are block diagrams of a side view, a top view, and a cross-section respectively, of an example modern gun system.
Figure 1B:
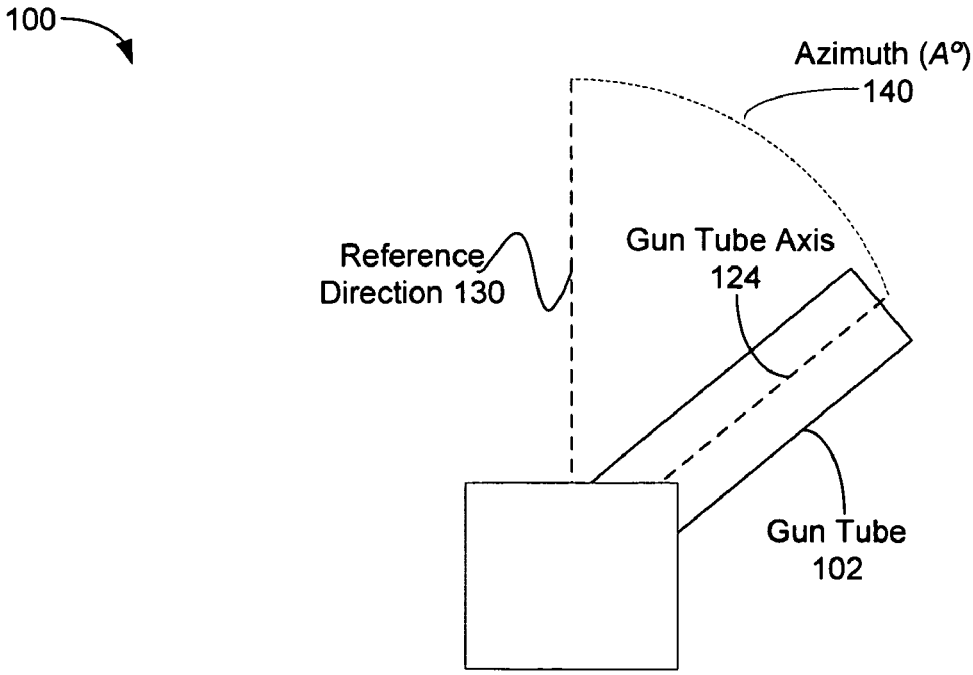
Figure 1B (Prior Art)
Figure 1C:
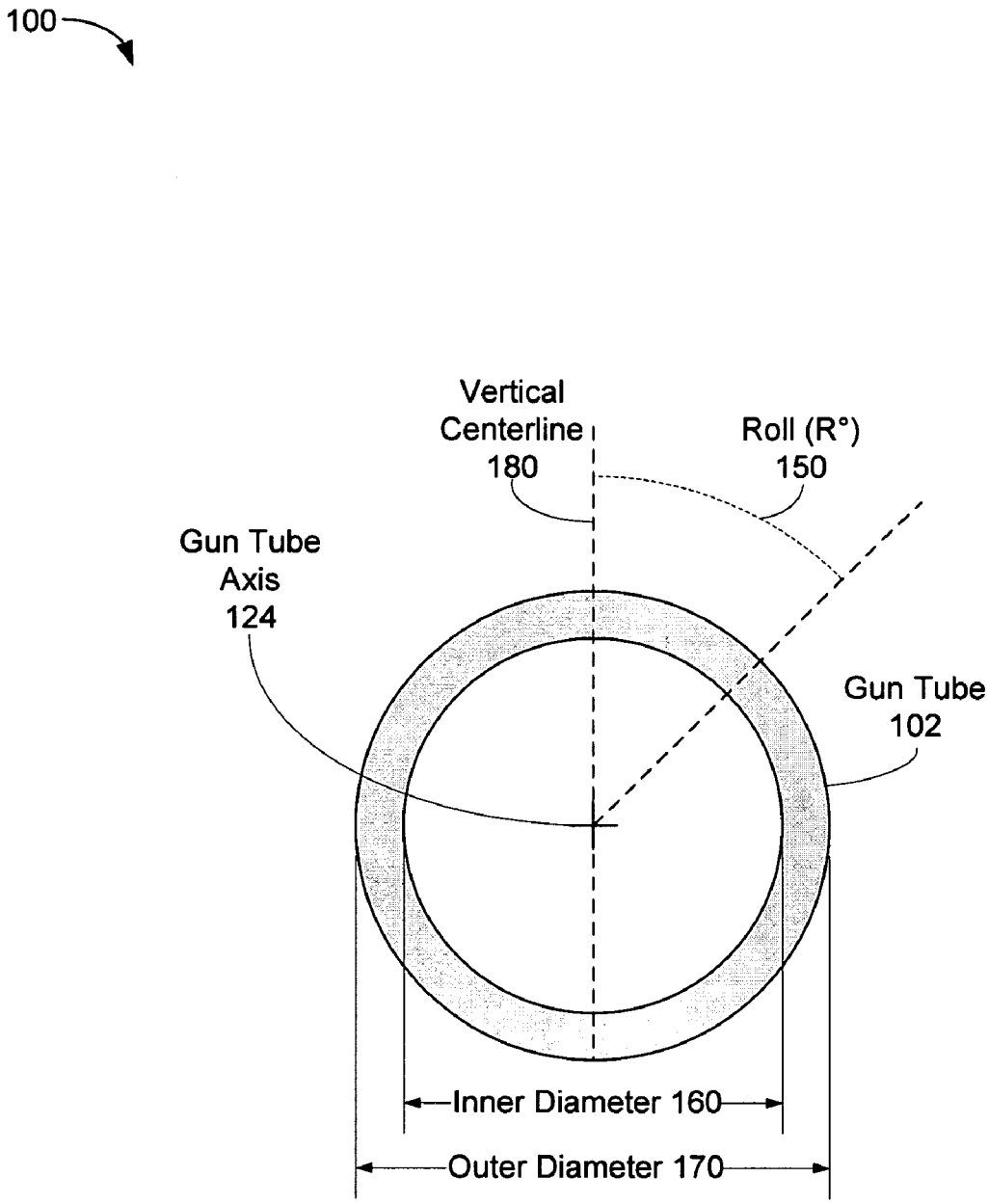
Figure 1C (Prior Art)

A method and apparatus are provided to initially boresight a gun system, calibrate the gun system, and verify the pointing accuracy of the gun system. Embodiments of the invention may include a device termed herein as a "boresight apparatus". The boresight apparatus may determine the actual gun-tube orientation.

To initially boresight a pointing system to the gun tube, a gun tube orientation for the gun-tube axis must be determined. The term "gun-tube orientation" is used herein to specify the set of the elevation, azimuth, and roll angles of the gun tube at a given time and the term "pointing-device orientation" is used herein to specify a gun-tube orientation as determined by a pointing device, such as pointing device 112.

To boresight the gun system, the pointing system is then adjusted to coincide with the orientation of the gun tube, and therefore, the pointing-system orientation will align with the gun-tube orientation. The pointing device may be adjusted physically, as in the case of an optical sight or a mechanical device used as a pointing device, or electronically, such as by specifying the offsets needed to compute the transform from the pointing device frame-of-reference to the gun tube frame-of-reference.

The invention employs a boresight apparatus and method to determine offsets to boresight a gun system. That is, the boresight apparatus and method determine the Euler angles between a gun-tube frame-of-reference and a pointing-device frame-of reference. An offset comparator may be configured to determine the offsets, the gun tube-to-pointing device transform, and/or the pointing device-to-gun tube transform simultaneously, thus indicating either subsystem orientation in terms of the complimentary frame-of-reference.

Some boresighting procedures may require multiple determinations of the boresight offset, such as at different gun tube elevation angles and/or gun tube azimuth angles. The herein-described boresight apparatus may be employed in these procedures with excellent results. Each gun tube orientation required by the procedure is established by means of the boresight apparatus and method as described previously. Thus, the boresighting procedure does not have to be altered to utilize the improved technology.

The complimentary function of verifying the performance of the pointing device involves determination of the gun-tube orientation and the pointing-device orientation. A deviation between the gun-tube orientation and the pointing-device orientation may be determined by comparing to the pointing-device orientation. Any component of such deviation that results from a boresight offset specification that is incorrect is termed "boresight error". Further, a "pointing error" may be determined between the pointing-device orientation and the actual gun-tube orientation. The term "pointing error" as used herein refers to the residual angular differences between the two frames of reference not accounted for by the offsets between the pointing-device frame-of-reference and the gun-tube frame-of-reference. The boresight apparatus may be used to determine and correct both boresight error and pointing device error.

If the pointing error is less than or equal to a threshold value, the gun system may be determined to be operating properly. However, if the pointing error is greater than the threshold value, the gun system may be determined to be operating improperly. Upon determining that the gun system is operating improperly, the pointing device may be repaired, replaced, and/or the gun system may be boresighted again. The term "directional angle" is used herein to specify any of the three angular components of a gun-tube orientation and/or any one of the elevation, azimuth, or roll angles.

Modern gun tubes are machined to tight tolerances. As such, the outer diameter of the gun tube is coaxial with the inner diameter (or deviates from it in a known fashion). Therefore, to determine the gun-tube orientation, the boresight apparatus may be mounted on the outside of the gun tube. Embodiments of the invention may locate the gun-tube axis of the gun tube by referencing the outer cylindrical surface of the gun tube. As such, determining the gun-tube axis with respect to the outer cylindrical surface of the gun tube is equivalent to specifying the gun-tube orientation, within the limits allowed by tolerances for the gun tube and boresight apparatus.

Different embodiments of the boresight apparatus may use different physical designs and/or different angle-measuring devices to measure one or more directional angles. One embodiment of the invention, described below with respect to FIGS. 3A, 3B, 3C, and 4, is a boresight apparatus comprising a 'V-block' platform such that the intersecting planes of the 'V' rest tangential to the surface of the tube cylinder and are thus parallel to the tube axis. In this embodiment, a laser and an array of photodiodes may align the gun system to a known azimuth.

In another embodiment of the invention, described below with respect to FIG. 5, a boresight apparatus includes two cylinders configured such that they are parallel to each other. When placed on a cylindrical section of the gun tube, this embodiment establishes the gun-tube axis using similar contact points as in the 'V-block' configuration. This embodiment may reduce weight and cost of the boresight apparatus.

Other embodiments are possible, such as those with mount configurations which establish contact points or areas on the tube surface. In all cases, the outer surface of the gun tube is exploited to determine the gun-tube axis.

The azimuth, elevation and roll measurements may be determined by the boresight apparatus. The azimuth may be determined using an optical technique described below with respect to FIGS. 3 and 4. The azimuth may be determined using "northfinding" techniques described below with respect to FIG. 5. Other techniques may be used to determine the azimuth as well.

The boresight apparatus may determine the elevation and roll angles relative to the gravity vector, which can be found by a number of methods. In one embodiment, precision spirit (bubble) levels are used. Implementations based on electronic fluid, moving mass, optical and micro-electromechanical system (MEMS) sensors are also possible. As such, the boresight apparatus and method described herein may be used to accurately determine each of the directional angles and thus determine a gun-tube orientation.

An Example Gun System

Figure 2:
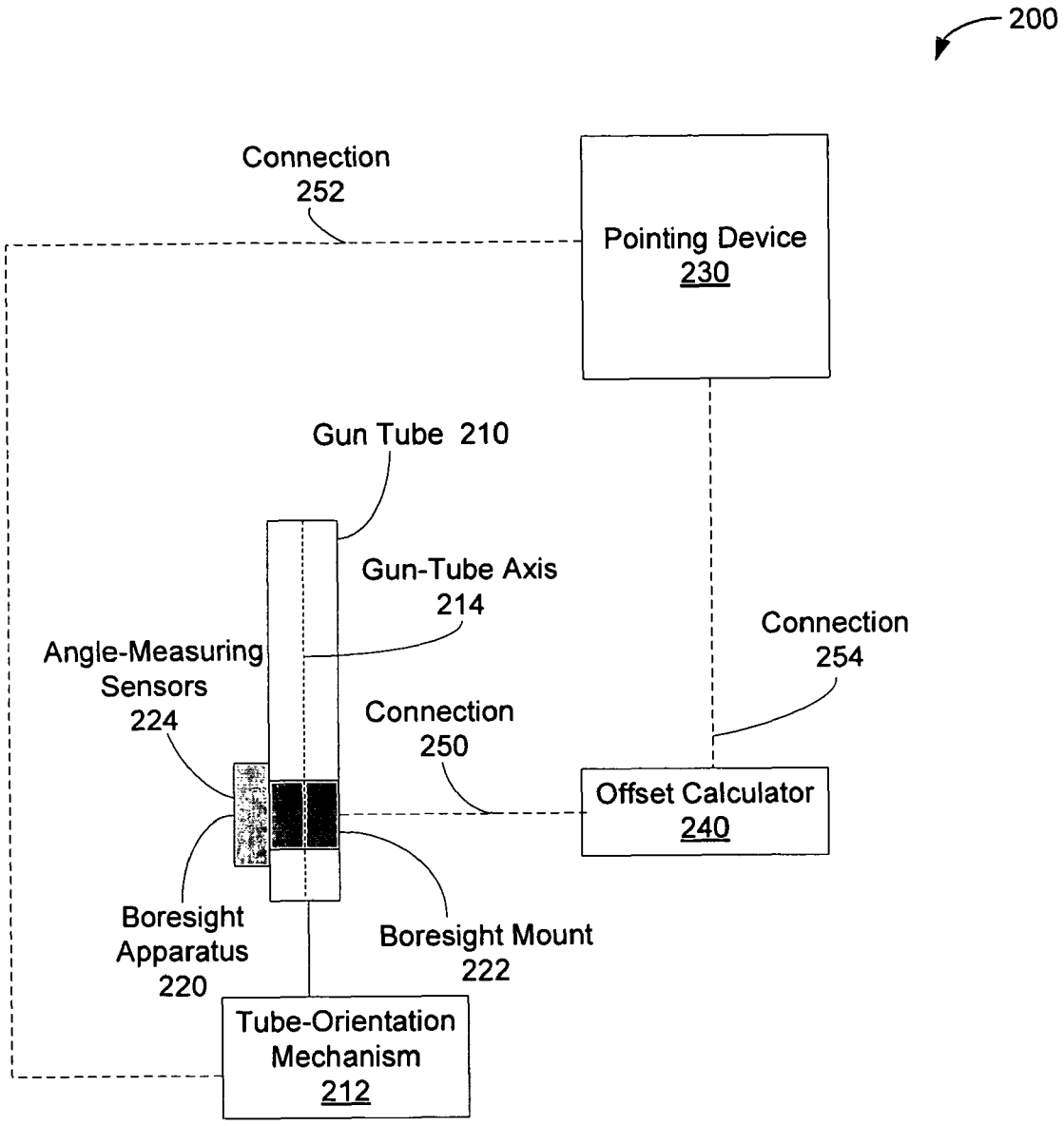
FIG. 2 shows a block diagram of an example gun system including a gun tube mounted with a boresight apparatus and connected to a pointing device and offset comparator in accordance with embodiments of the invention.

Turning to the figures, FIG. 2 shows a block diagram of a gun system 200 with a gun tube 210 mounted with a boresight apparatus 220 and connected to a pointing device 230 and offset comparator 240 in accordance with embodiments of the invention.

FIG. 2 shows the gun tube 210 connected to a tube-orientation mechanism 212. The tube-orientation mechanism 212 may aim the gun system 200 by moving the gun tube 210. The tube-orientation mechanism 212 may include one or more devices to move the gun tube along one or more adjustment angles. For example, the tube-orientation mechanism 212 may include a motor or a hand-turned crank that allows the gun tube 210 to be raised or lowered, thereby adjusting the elevation of the gun tube 210. As another example, the tube-orientation mechanism 212 may include wheels to permit movement of the gun tube 210 as well, and thus change the azimuth of the gun tube 210. The tube-orientation mechanism 212 may be configured to allow adjustments to the roll of the gun tube, as in the case of 'cant adjustments' or cross-level mechanisms. FIG. 2 shows gun tube 210 with gun-tube axis 214 running FIG. 2 shows the boresight apparatus 220 with a boresight mount 222 and angle-measuring sensors 224. The angle-measuring sensors 224 may contain one or more sensors or other means to determine the azimuth, elevation and/or roll angles. The components of the boresight apparatus are indicated with a grey color in FIG. 2. The boresight mount 222 permits the boresight apparatus 220 to be mounted on the outside of the gun tube 210. In particular, the angle-measuring sensors 224 are mounted on the outside of the gun tube 210. The boresight apparatus may determine a gun-tube orientation, comprising one or more directional angles, for the gun tube. The gun-tube orientation may be determined by measuring one or more directional angles of the gun tube using the angle-measuring sensors 224.

The pointing device 230 may be configured to determine a pointing-device orientation and/or one or more pointing-device-directional angles of the gun tube 210. The pointing device 230 may be an electronic pointing device, an optical pointing device, and/or a mechanical pointing device. The tube-orientation mechanism 212 may be connected to a pointing device 230 via a connection 252. The connection 252 may be a mechanical coupling, electro-mechanical connection, a wired connection for communications, and/or a wireless connection for communications.

The pointing-device orientation may be compared to a reference gun-tube orientation, such as the actual gun-tube orientation, to initialize and/or determine the performance of the gun system 200. In particular, the pointing-device orientation may be compared to a gun-tube orientation determined by boresight apparatus 210.

Then, "offsets" may be determined between the boresight gun-tube orientation and the pointing-device orientation, perhaps by using the offset comparator 240. "Offsets" or angular differences between the orientations of the gun tube and pointing device may be determined. In an alternate embodiment, this determination can also be made by the user as a hand calculation The term "offsets" or "offset angles" as used herein refers to a set of three angles that specify a rotational transform between one frame-of-reference, such as that of the gun tube, and another frame-of-reference, such as that of the pointing device. The offsets may be specified using "Euler angles". The Euler angles are three angles that specify an arbitrary rotation or "transform" from one three-dimensional frame-of-reference to another, such as a gun-tube-to-pointing device transform or a pointing-device-to-gun-tube transform.

Thus, in terms of offsets, boresighting is the determination of the offsets between the gun-tube frame-of-reference and the pointing-device frame-of-reference. Using the offsets, the gun tube 210 and pointing device 230 can be aligned mathematically even though their physical orientations still differ. For example, the pointing-device frame-of-reference for modern electronic systems is based on the geodetic grid and the gravity vector. In fire control applications, the pointing-device frame-of-reference may be aligned mathematically to the gun tube frame-of-reference. This alignment may be performed using a gun-tube-to-pointing device transform and/or a pointing-device-to-gun-tube transform defined by the offsets for a particular gun tube/pointing device pair.

For mechanical pointing devices, the offsets may be determined mechanically for a given aimpoint, such as a distant aiming point. For electronic pointing devices the offsets are employed differently. Once the offsets are specified, the translation of any pointing-device orientation to the corresponding gun-tube orientation is by means of the transform utilizing Euler angles described above. In practice, the requisite computations may be incorporated in the pointing device 230, and may employ one of a number of representations of the angular relationships involved, such as various Direction Cosine Matrices, Quaternions, etc. Once the offsets are provided to the pointing device 230, the pointing device 230 may provide pointing information to the gun system 200 in the gun tube frame-of-reference.

The offset comparator 240 may be connected to the boresight apparatus 220 and the pointing device 230. The offset comparator 240 may include a computer processor, data storage, and machine language instructions within the data storage operable to perform functions. The offset comparator 240 may determine an offset between the gun tube orientation and the pointing-device orientation.

The offset comparator 240 may be configured to determine a gun tube-to-pointing device transform and/or a pointing device-to-gun tube transform. Further, the offset comparator 240 may determine the offsets, the gun tube-to-pointing device transform, and the pointing device-to-gun tube transform simultaneously, thus indicating either the gun-tube orientation or the pointing-device orientation in terms of the complimentary frame-of-reference, as well as the offsets.

The offset comparator 240 may be used to determine several different gun-tube orientations during a boresighting procedure, such as gun-tube orientations at different gun-tube elevation angles and/or gun-tube azimuth angles. The offset comparator 240 may store each determined gun-tube orientation at each different elevation and/or azimuth, and then utilize the stored gun-tube orientation as part of the boresighting procedure.

To determine gun system pointing performance, the boresight apparatus 210 may establish a desired gun-tube orientation. The pointing-device orientation is compared with the desired gun-tube orientation, perhaps using the offset comparator 240. If the angular differences are within the gun system performance specification (e.g., less than some allowed maximum) the system pointing accuracy is verified. If the angular differences are greater than the system performance specification allows, the gun system must be re-boresighted to return it to an operational state. Components of the system, such as the pointing device 230, may be repaired or replaced, as part of re-boresighting.

An Example V-Block Boresight Apparatus

Figure 3A:
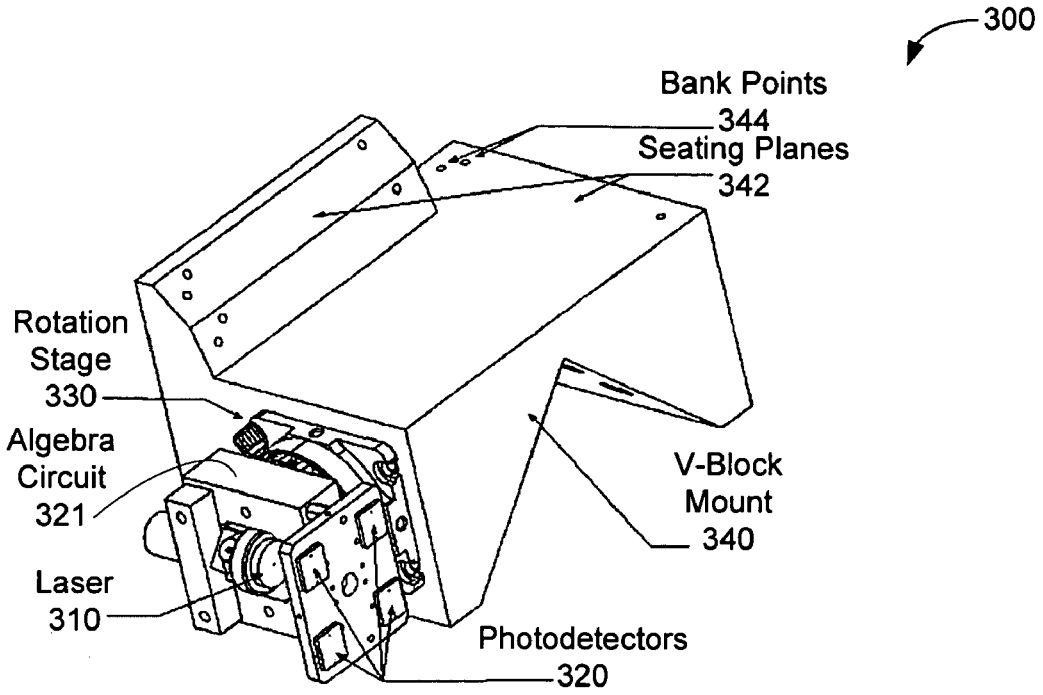
FIG. 3A depicts an example boresight apparatus in accordance with embodiments of the invention.

FIG. 3A depicts an example boresight apparatus 300 in accordance with embodiments of the invention. FIG. 3A shows boresight apparatus 300 with a laser 310, four photodetectors 320, a rotation stage 330, and a V-block mount 340 with seating planes 342 and bank points 344 in accordance with embodiments of the invention.

The boresight apparatus 300 uses the laser 310 mounted on a precision rotation stage 330 to determine an azimuth of a gun tube of a weapon system. An array of photodetectors 320 receives the laser energy emitted from laser 310. Each of the photodetectors 320 may be a photodiode or other device capable of detecting energy emitted from laser 310. The photodetectors may detect the energy emitted from laser 310 upon return from a retro-reflector set at a surveyed distant aiming point. See FIG. 4 for a depiction of the use of a boresight apparatus, such as the boresight apparatus 300, with a retro-reflector.

The boresight apparatus 300 may be installed and aligned before use. The boresight apparatus 300 is installed by attaching the boresight apparatus to the outside of a gun tube. The boresight apparatus 300 may employ magnets, straps, or similar connectors to fix the apparatus to the gun tube and allow easy removal. As such, the boresight apparatus 300 can be removably mounted to a gun tube.

The V-block mount 340 of the boresight apparatus 300 references the outer surface of the gun tube to locate the gun-tube axis (not shown in FIGS. 3A and 3C) such that the laser 310 is parallel with the gun-tube axis. Also, the photodetectors 320 are concentric to the laser 310. As such, the boresight apparatus 300 allows for detection (via photodetectors 320) of a return laser beam emitted from laser 310 which is coaxial with the emitted laser beam and parallel to the gun-tube axis.

The boresight apparatus 300 may determine and/or adjust the elevation and the roll of the gun tube. The elevation and/or roll of the boresight apparatus, and hence the gun tube, may be determined using various devices that can measure an angle relative to the gravity vector, such as, but not limited to spirit levels, inclinometers, and tip/tilt sensors. FIG. 3A shows precision seating planes 342 and bank points 344 that permit installation of an Artillery Gunner's Quadrant to determine elevation and roll. An Artillery Gunner's Quadrant may comprise micrometer adjustable spirit levels capable of 0.006 degree measurements in both elevation and roll.

The rotation stage 330 may be used to align laser 310 precisely with a reflector, such as retro-reflector 422 described below with respect to FIG. 4. In particular, the rotation stage 330 may position the laser 310 such that the laser 310 is free to rotate in a plane parallel to the plane containing the gun-tube axis as the elevation of the gun tube changes. Thus, the laser 310 may illuminate the reflector over the full range of tube elevations without deviations in azimuth.

Figure 3B:
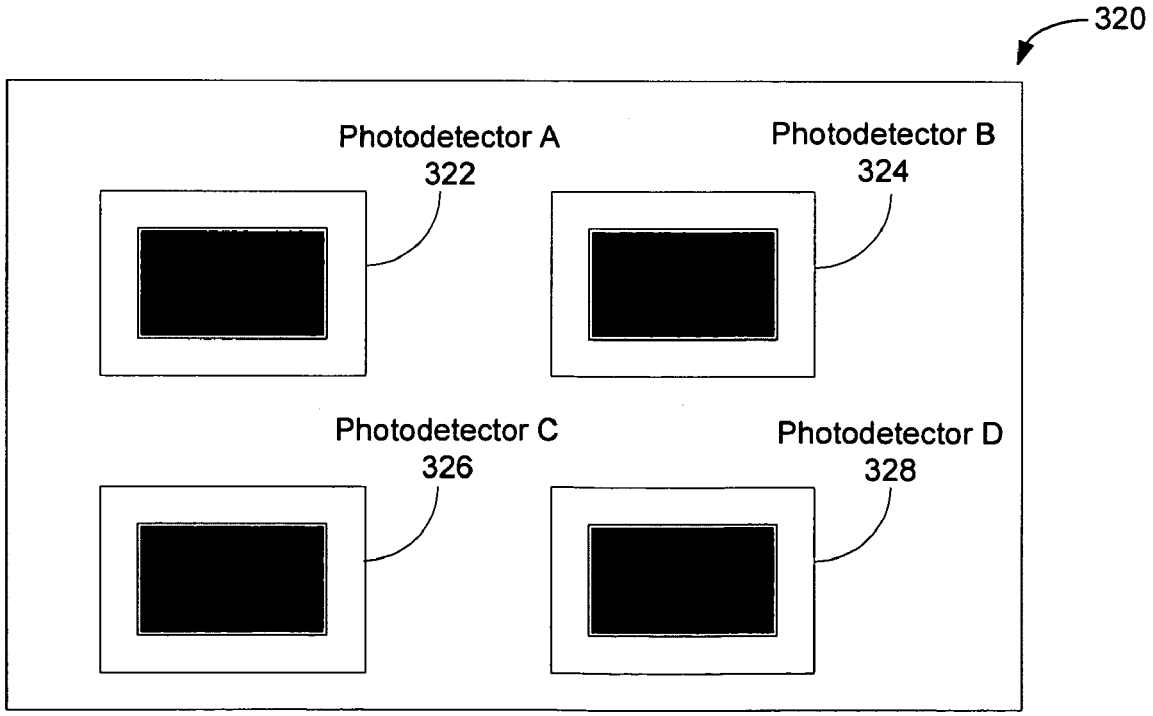
FIG. 3B shows a block diagram of example photodetectors in accordance with embodiments of the invention.

FIG. 3B shows a block diagram of the four photodetectors 320 in accordance with embodiments of the invention. The four photodetectors 320 of FIG. 3A are shown labeled in FIG. 3B as photodetector A 322, photodetector B 324, photodetector C 326, and photodetector D 328 (a central laser aperture is not shown).

An algebra circuit 321 receives inputs from the photodetectors 320 and provides an indication of when the return laser signal is centered about the laser emitter point. The algebra circuit 321 takes inputs from each of the photodetectors 322-328 and determines an output corresponding to the alignment of laser 310. When the laser 310 emits a laser beam, the laser beam may be reflected by a reflector (such as the retro-reflector 422) back toward photodetectors 322-328. Therefore, depending on the alignment of the emitted laser beam and the reflector, one or more of the photodetectors 322-328 may detect the reflected laser beam.

Each photodetector may provide an analog output such that zero volts represents no light detected and a maximum voltage (Vmax) represents the maximum possible reflected laser energy. The algebra circuit 321 may then take the outputs from the photodetectors as inputs and calculate the following algebra circuit output (ACO):

$$ACO=(A-D)+(B-C),$$

where:

A=the output from the photodetector A 322,

B=the output from the photodetector B 324,

C=the output from the photodetector C 326,

D=the output from the photodetector D 328,

However, some configurations of the outputs from the photodetectors 322-328 may be physically impossible since the reflected beam is circular in cross section, larger than the array of photodetectors 320, and parallel to the emitted beam. The outputs that sum to zero algebraically but are physically impossible are indicated with "X"'s in Table 1 below.

Table 1 shows possible ACO output values, based on inputs from each of photodetectors 322-328. A '0' in Table 1 indicates a "no light" condition and a '1' in Table indicates a maximum detector response to illustrate the function of the algebra circuit 321. The ACO values may be calculated for physically possible responses of the four photodetectors 322-328.

TABLE 1

| Photodetector | Input Values | | | | | | | | | | | | | | | |
|---|---|---|---|---|---|---|---|---|---|---|---|---|---|---|---|---|
| Photodetector A 322 | 0 | 0 | 0 | 0 | 0 | 0 | 0 | 0 | 1 | 1 | 1 | 1 | 1 | 1 | 1 | 1 |
| Photodetector B 324 | 0 | 0 | 0 | 0 | 1 | 1 | 1 | 1 | 0 | 0 | 0 | 0 | 1 | 1 | 1 | 1 |

TABLE 1-continued

| Photodetector | Input Values | | | | | | | | | | | | | | | |
|---|---|---|---|---|---|---|---|---|---|---|---|---|---|---|---|---|
| Photodetector C 326 | 0 | 0 | 1 | 1 | 0 | 0 | 1 | 1 | 0 | 0 | 1 | 1 | 0 | 0 | 1 | 1 |
| Photodetector D 328 | 0 | 1 | 0 | 1 | 0 | 1 | 0 | 1 | 0 | 1 | 0 | 1 | 0 | 1 | 0 | 1 |
| ACO Value: | 0 | −1 | −1 | −2 | 1 | X | X | −1 | 1 | X | X | −1 | 2 | 1 | 1 | 0 |
| ACO = (A-D) + (B-C) | | | | | | | | | | | | | | | | |
| (X = cannot physically occur) | | | | | | | | | | | | | | | | |

The boresight apparatus 300 is aligned, that is the reflected laser beam is coaxial with the emitted laser beam, when both: (a) the ACO is 0 (i.e., each photodetector is equally illuminated) and (b) each of the four photodetectors 322-328 is detecting light (the other balanced condition is that no light falls on any photodetector). The use of algebra circuit 321 lessens any interpretation based on visual acuity or judgment.

Other configurations of photodetectors 320 are possible, such as more or fewer photodetectors, use of photodetectors in different patterns (e.g., arranged in a circular pattern), and photodetectors that respond to other wavelengths. Other highly directional light sources may replace the use of laser 310. Upon changing the configuration of the photodetectors 320, the algebra circuit 321 may have to be modified to calculate the ACO based on the changed configuration of the photodetectors 320.

Figure 3C:
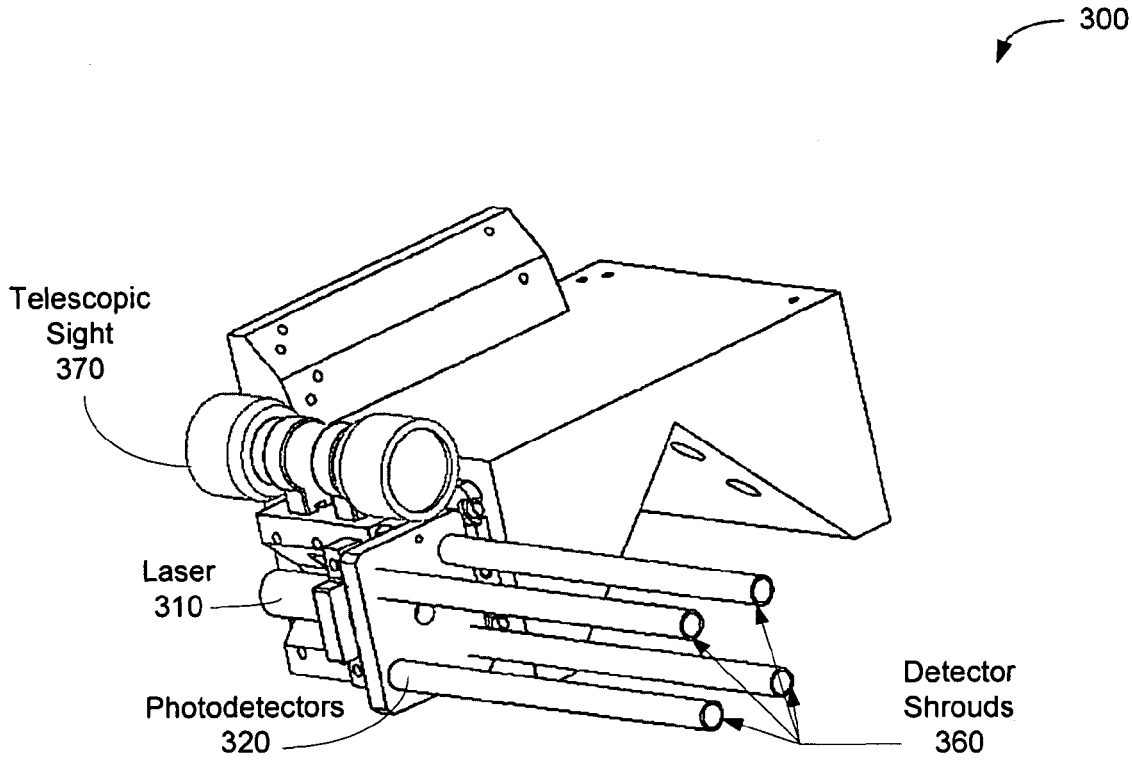
FIG. 3C shows an example boresight apparatus equipped with detector shrouds and a telescopic sight in accordance with embodiments of the invention.

FIG. 3C shows an example boresight apparatus 300 equipped with detector shrouds 360 and a telescopic sight 370 in accordance with embodiments of the invention. Reflected laser light may be difficult to detect during bright light conditions, such as a sunny day. As such, the detector shrouds 360 may be used as part of boresight apparatus 300 to shield the photodetectors 320 from ambient light. Detector shrouds may exclude most ambient light and therefore allow only on-axis (laser) illumination of the photodetectors 320. FIG. 3C also shows the boresight apparatus 300 including a telescopic sight 370 for 'roughing in' alignment to a distant target that may provide for faster alignment of boresight apparatus 300.

Figure 4:
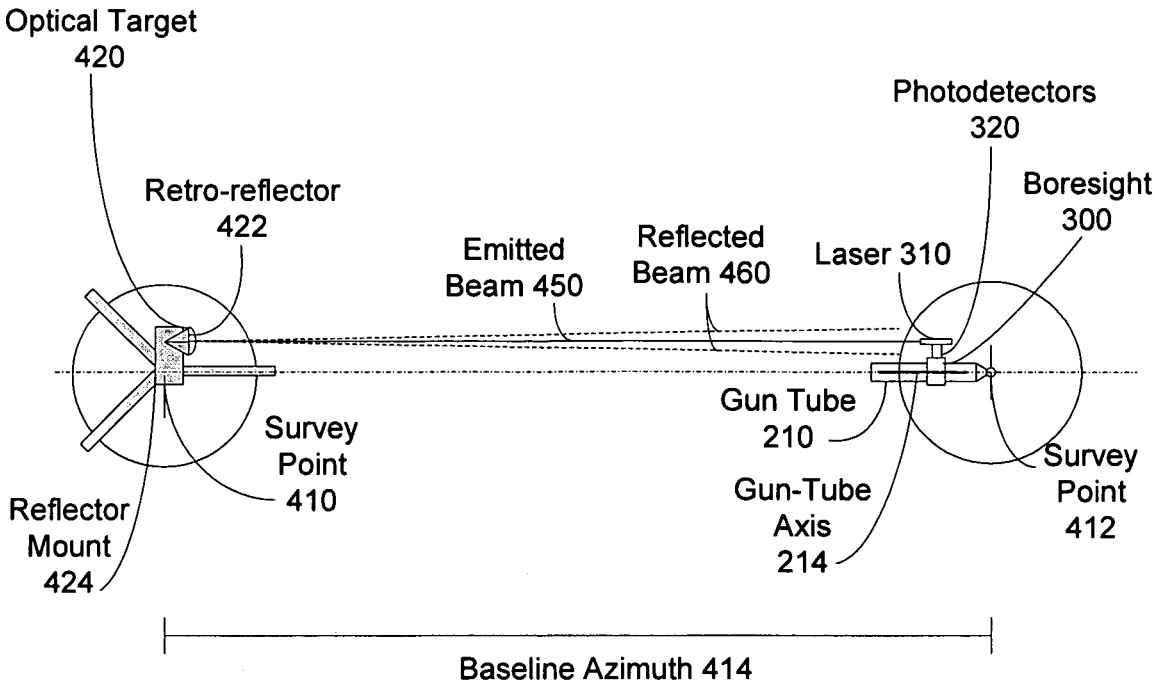
FIG. 4 shows an example scenario for the use of a boresight apparatus in accordance with embodiments of the invention.

FIG. 4 shows an example scenario for the use of the boresight apparatus 300 in accordance with embodiments of the invention. FIG. 4 shows two survey points 410 and 412. The locations of the two survey points 410 and 412 are known to a high degree of precision, such as determined by a "precision survey" or land survey between the survey points 410 and 412. In particular, a baseline azimuth 414 between the survey points 410 and 412 is well known to a high degree of precision. For example, if the distance between survey points 410 and 412 is 150 meters, the location of survey points 410 and 412 may be known to within 1 millimeter. Based on the precise locations of the survey points 410 and 412, the baseline azimuth 414, which is the direction from the survey point 410 to survey point 412 (or vice versa) with respect to a geodetic grid, can be determined to a high degree of precision.

An optical target 420 may be placed at the survey point 410 and a gun tube 210 may be placed at the survey point 412 (or vice versa), where the gun-tube axis 214 is aligned with the baseline survey 414. FIG. 4 shows an optical target 420 with a retro-reflector 422 mounted on a reflector mount 420 placed at survey point 410 and the gun tube 210 placed a survey point 412. FIG. 4 also shows the gun-tube axis 214 aligned with the baseline azimuth 414. The optical target 420 may be fabricated such that the retro-reflector 422 is a corner cube or other laser reflector. The retro-reflector may reflect a laser beam emitted from a laser, such as laser 310, within a desired degree of parallelism, such as within 1 arc-second. The gun tube 210 may be placed such that a gun-tube axis 214 is centered on the line connecting survey points 410 and 412.

FIG. 4 also shows the boresight apparatus 300 mounted on the gun tube 210. A "standoff distance", or distance from the survey point 410 to a point on an optical axis of the optical target 420, may be measured to equal the distance from the gun-tube axis 210 (which passes through the survey point 412) to an optical axis of the laser 310 mounted on boresight apparatus 300. Using a standoff distance equal to the distance from the gun-tube axis 210 to the optical axis of the laser 310 ensures that the optical axis of the boresight apparatus 300 is parallel to the baseline azimuth 414.

Once the laser 310 and optical target 420 have been placed on the survey points 412 and 410, respectively, the laser 310 of boresight apparatus 300 may be energized to emit an emitted beam 450. The emitted beam 450 may strike the retro-reflector 422 and be reflected back as a reflected beam 460 toward the boresight apparatus 300. The photodetectors 320 of boresight apparatus 300 may detect the reflected beam 460 and determine if the reflected beam 460 is coaxial laser 310 as described with respect to FIG. 3B. If the reflected beam 460 is not coaxial with the beam emitted from the laser 310, the boresight apparatus 300 may be precisely rotated in the elevation plane using rotation stage 330 shown in FIG. 3A and the gun tube azimuth adjusted until the photodetectors 320 indicate that the reflected beam 460 is coaxial with the emitted beam from laser 310. The gun tube is then oriented on the surveyed azimuth.

Once the reflected beam 460 is coaxial with the laser 310, and thus with the baseline azimuth 414, the azimuth of the gun tube 210 may be determined. For the boresight apparatus 300 on a 150 meter baseline, measurements of the gun-tube orientation have been determined to within 0.028 degrees for each directional angle. This may represent a substantial improvement over other methods demonstrated to date, particularly in the determination of the azimuth of the gun tube 210. As such, the boresight apparatus 300 determines the azimuth by use of optical technology (e.g., the laser 310, photodetector 320, and/or optical target 420) with a precision survey.

Azimuth Determination

Azimuth may be determined using the optical technology with a precision survey technique described above with reference to FIGS. 3A, 3B, 3C, and 4. Azimuth may also determined by magnetic means (such as a solid state compass), and/or 'north-finders' employing angular rate sensors and/or gyroscopes. Modern electronic compasses are miniaturized and compensated for tip/tilt and magnetic declination. Angular rate sensors and gyroscopes may be based on moving mass, optical, or MEMS technologies, among others.

The classical northfinding technique, as described by Titterton and Weston, uses a gyroscope with two degrees of freedom, such as a dynamically tuned gyroscope with a vertical spin axis. D. H. Titterton and J. L. Weston, Strapdown Inertial Navigation Technology, Revised Second Edition, AIAA, 2004, pp. 287-288. The gyroscope may be vertically suspended, via a wire or other support, and thus be automatically leveled in two dimensions corresponding to two input axes of the gyroscope. The input axes may be held in a loop to enable measurement of the rate of rotation about each input axis. The gyroscope may be held within a fluid-filled assembly to provide damping.

In this configuration, the gyroscope may measure a heading angle of the gyroscope ψ relative to the earth's axis of rotation; that is ψ is the angle between the gyroscope and true north. ψ may be determined by: (1) determining the rates of rotation about each input axis, where $\omega_x$ is the rate of rotation about the first input axis and $\omega_y$ is the rate of rotation about the second input axis, (2) determining the ratio $$R = \frac{\omega_y}{\omega_x}$$

of the rates of rotation, and (3) determining the heading angle of the gyroscope ψ to be the arctangent of R, or when 90° minus the arctangent of R, when $\omega_x$ is very close to zero. In the case that the gyroscope is aligned with the gun-tube axis, ψ may then be used as the azimuth of the gun tube.

Titterton and Weston indicate receiving useful accuracy of the heading angle using only one gyroscope requires a very precise measurement of the heading angle of the gyroscope. Titterton and Weston suggest recalculating the heading angle of the gyroscope after rotating the gyroscope 90°, 180°, and/or 270° about the vertical to allow for less precise measurements of the heading angle of the gyroscope.

An Example Parallel-Cylinder Boresight Apparatus

Figure 5A:
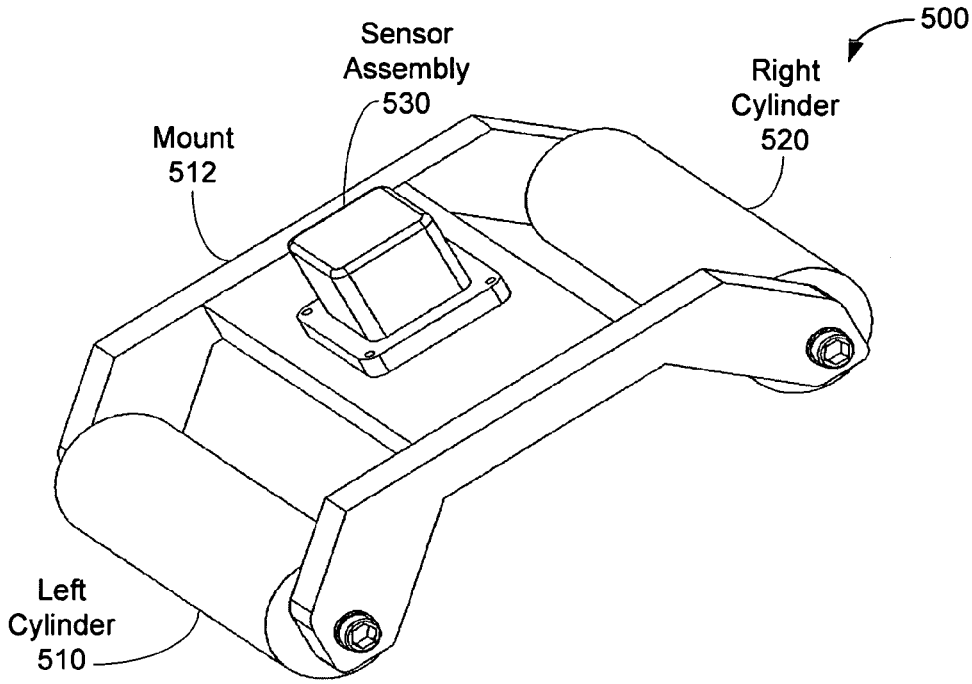
FIG. 5 shows another example boresight apparatus mounted on a gun tube in accordance with embodiments of the invention.

FIG. 5A shows a boresight apparatus 500 with two parallel cylinders 510 and 520 and a sensor assembly 530, in accordance with embodiments of the invention. The two parallel cylinders—a left cylinder 510 and a right cylinder 520—connected by a mount 512. As such, the boresight apparatus 500 may be termed a "parallel-cylinder boresight apparatus" in contrast to the boresight apparatus 300, which may be termed a "V-block boresight apparatus". The mount 512 may be fashioned to permit adjustment of the boresight apparatus 500 to accurately measure directional angles when mounted on the outside of gun tubes of various sizes.

The sensor assembly 530 may include one or more angle-measuring devices to measure at least one directional angle, such as the azimuth of the gun tube 210. In particular, the sensor assembly 530 may include angle-measuring devices to measure the azimuth, roll, and elevation of the gun tube 210. The sensor assembly 530 may use the angle-measuring devices described above with respect to the boresight apparatus 300 and FIGS. 3A, 3B, 3C, and 4, angular rate sensors, gyroscopes, magnetic means (e.g., compasses), and/or some other angle measuring device(s) suitable for measuring at least the azimuth of the gun tube 210.

The elevation and/or roll of the boresight apparatus 500 may be determined using various angle-measuring devices that can measure an angle relative to the gravity vector, such as, but not limited to spirit levels, inclinometers, and tip/tilt sensors. The sensor assembly 530 may include such devices for measuring the elevation and/or the roll. The sensor assembly 530 and/or the mount 510 may be fabricated with a mount for a gunnery quadrant or other device external to the boresight apparatus 500 used to determine the roll and/or elevation angles of the boresight apparatus 500, such as the seating planes 342 and the bank points 344 of the boresight apparatus 300.

The angle-measuring device(s) of the sensor assembly 530 may be aligned during fabrication of the boresight apparatus 500 such that any elevation and roll sensors are aligned with reference to a plane parallel to the plane defined by the axes of the two parallel cylinders 510 and 520 (which locate the gun-tube axis). The azimuth sensor is aligned with reference to the axes of the two parallel cylinders 510 and 520. These alignments may be further adjusted during a calibration procedure of the sensor assembly 530. It is to be understood that the V-block boresight apparatus 300 may include the sensor assembly 530 and that the angle measurement techniques described for the V-block boresight apparatus 300 may be used on the parallel-cylinder boresight apparatus 500 or other possible configurations that register on the gun tube outer surface to locate the gun-tube axis.

Other boresight apparatus beyond the example boresight apparatus 300 and 500 mounted on the outside of a gun tube are possible as well. Generally, a boresight and/or a sensor assembly may utilize various technologies to measure directional angles, such as, but not limited to, optical technologies (including lasers), electrical technologies, magnetic technologies, mechanical technologies, including MEMS, electromechanical, and opto-mechanical technologies, and combinations of these (or other) technologies. A boresight apparatus and/or a sensor assembly may determine the azimuth, roll, and/or elevation directional angles using a variety of devices, including, but not limited to, devices that receive satellite or other communication signals (e.g., GPS), magnetic compasses, devices that implement visual reckoning techniques, ring laser gyroscopes, as well as uses of lasers, spirit levels, tip/tilt sensors, inclinometers, and/or gyroscopes not specifically disclosed herein.

Figure 5B:
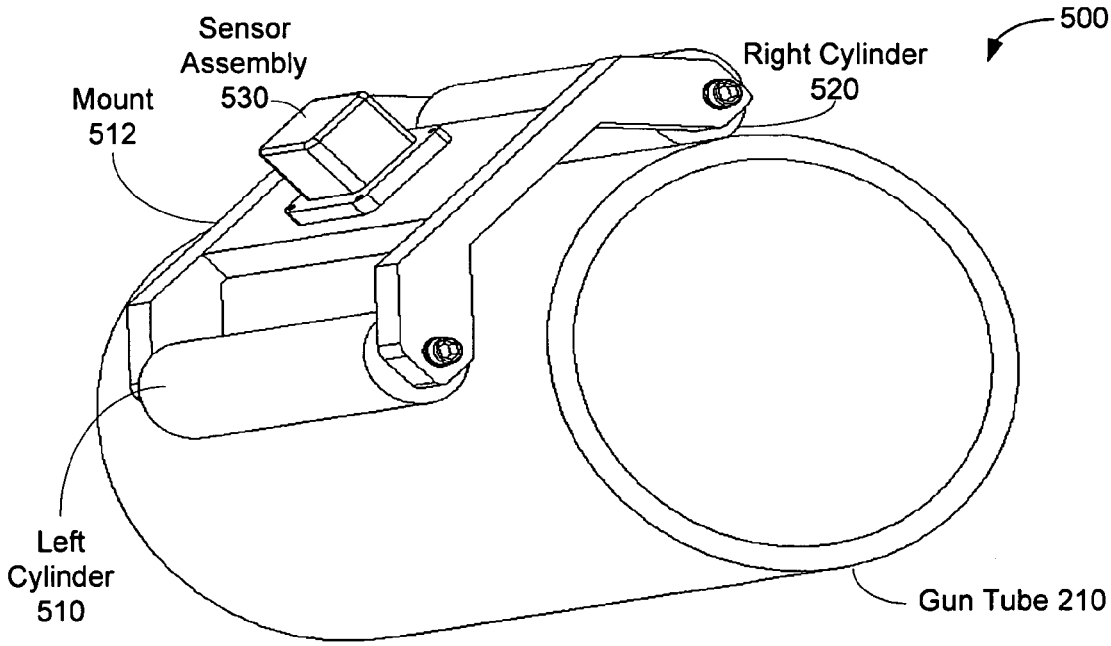

FIG. 5B shows the boresight apparatus 500 mounted on a gun tube 210 in accordance with embodiments of the invention. The boresight apparatus 500 is installed by attaching the boresight apparatus 500 to the outside of the gun tube 210. The boresight apparatus 500 may employ rare-earth magnets to fix the apparatus to the gun tube and yet allow easy removal. As such, the boresight apparatus 500 can be removably mounted to a gun tube.

A boresight apparatus may be mounted to the outside of a gun tube using a V-Block mount such as described with respect to the boresight apparatus 300, a parallel-cylinder mount such as described with respect to the boresight apparatus 500, or another mount configured to attach a boresight apparatus to the outside of a gun tube. While the embodiments of the invention described herein are indicated as removably mounted to a gun tube, a boresight apparatus permanently mounted to the outside of a gun tube may be used as well while still being within the spirit of the invention disclosed herein.

An Example Method for Boresighting a Gun System

Figure 6:
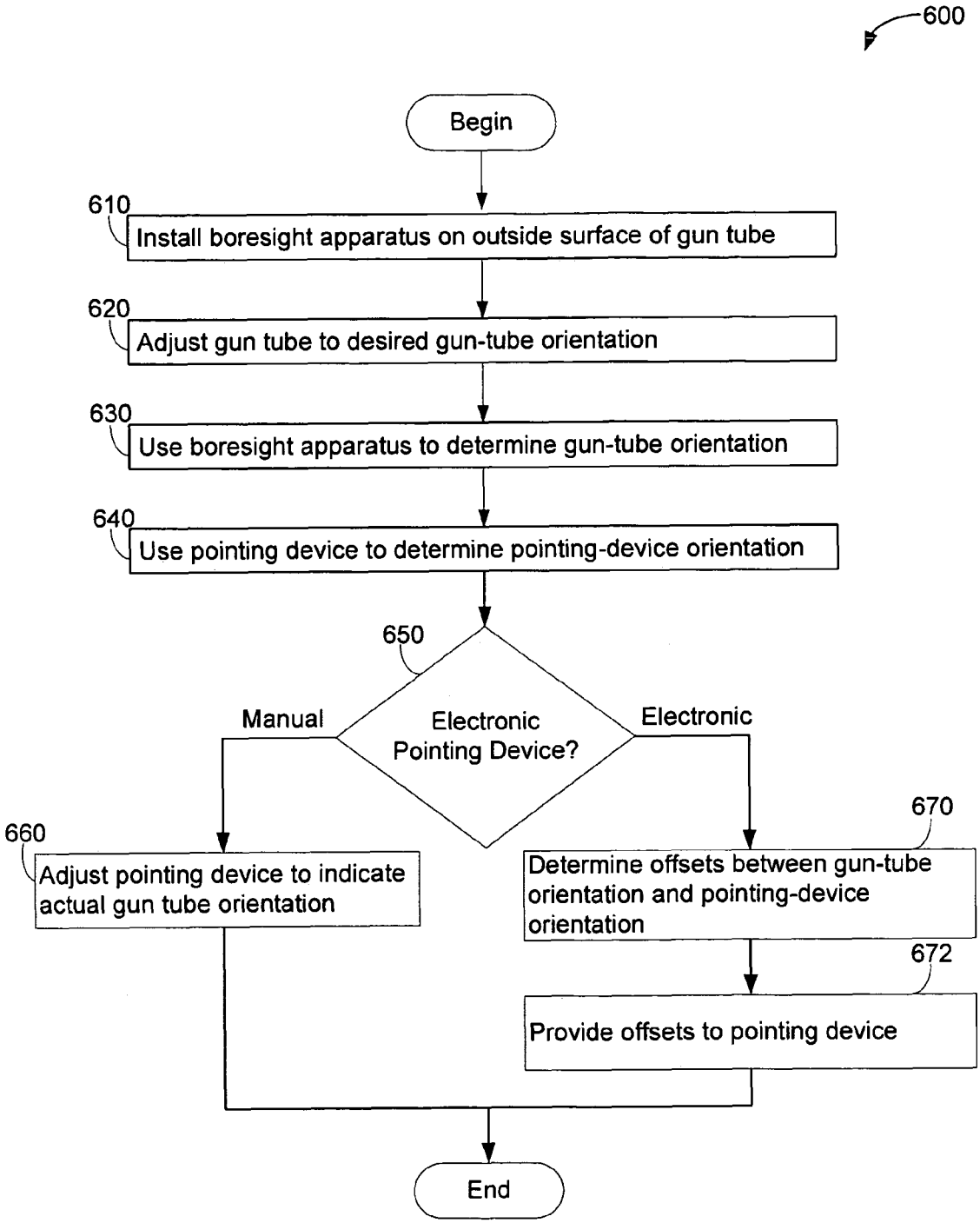
FIG. 6 is a flowchart of an example method in accordance with embodiments of the invention.

FIG. 6 is a flowchart of an example method 600 for initializing a pointing device of a gun system in accordance with embodiments of the invention. It should be understood that one or more of the blocks in this flowchart and within other flowcharts presented herein may represent a module, segment, or portion of computer program code, which includes one or more executable instructions for implementing specific logical functions or steps in the process. Alternate implementations are included within the scope of the example embodiments in which functions may be executed out of order from that shown or discussed, including substantially concurrently or in reverse order, depending on the functionality involved, as would be understood by those reasonably skilled in the art of the described embodiments.

At block 610, a boresight apparatus may be installed on an outside surface of a gun tube. The boresight apparatus may be installed by placing the boresight apparatus on the outside surface of the gun tube such that the boresight apparatus properly registers on the gun tube cylinder and the axis of the boresight apparatus is parallel to a gun-tube axis. The boresight apparatus may be attached to the gun tube using magnets or other means of attachment. Other means of attachment may include, but are not limited to, straps, chains, ropes, strings, latches, buckles, cords, suction cups, screws, bolts, fasteners, and any other device suitable to attach the boresight apparatus temporarily to the gun tube.

If an optical target, such as a retro-reflector, is employed for determination of an azimuth, the boresight apparatus may be installed such that an axis of the boresight apparatus (e.g., an optical axis of a laser) is oriented with respect to the optical target as well. In particular, the boresight apparatus may be oriented so that the distance from the gun-tube axis to the axis of the laser is equal to an offset distance from the target surveyed point to the optical target.

At block 620, the gun tube may be adjusted to a desired gun-tube orientation. The gun tube may be adjusted to the desired gun-tube orientation using an adjustment mechanism. The desired gun-tube orientation may comprise a desired elevation, a desired roll, and/or a desired azimuth. In particular, maneuvering the gun tube to a desired gun-tube orientation may comprise maneuvering the gun tube along a known azimuth, such as a baseline azimuth determined during a survey. One or more devices, such as an elevation/roll device, tip/tilt sensors, inclinometers, and/or spirit levels, may be used to determine that the gun tube is at the desired elevation.

At block 630, the boresight apparatus may be used to determine the gun-tube orientation. In particular, the boresight apparatus may determine an azimuth of the gun tube.

If the boresight apparatus comprises a laser, the laser may be energized to emit an emitted beam. The emitted beam may strike an optical target. The optical target may comprise a retro-reflector to reflect the emitted beam, causing a reflected beam to be sent toward the boresight apparatus. One or more photodetectors may detect the reflected beam. A circuit, such as an algebra circuit, coupled to the photodetectors may indicate that the reflected beam is coaxial with the emitted beam. The boresight apparatus may determine the azimuth is the known azimuth upon determining the reflected beam is coaxial with the laser.

The boresight apparatus may also or instead use a north-finding technique or other means such as described above with respect to FIGS. 5A and 5B, to determine the azimuth component of the gun-tube orientation.

The boresight apparatus may determine an elevation and/or a roll component of the gun-tube orientation using various devices that can measure an angle relative to the gravity vector, such as, but not limited to a roll/elevation device, spirit levels, inclinometers, and/or tip/tilt sensors.

At block 640, a pointing device may be used to determine a pointing-device orientation based on the gun-tube orientation. The pointing device may be aligned to the gun-tube orientation and then determine the pointing-device orientation.

At block 650, a determination is made as to whether the pointing device is an electronic pointing device or a manual pointing device. The pointing device may be an electronic pointing device, an optical pointing device, and/or a mechanical pointing device. The term "manual pointing device" is used herein to describe either an optical or a mechanical pointing device.

If the pointing device is a manual pointing device, method 600 proceeds to block 660. IF the device is an electronic pointing device, method 600 proceeds to block 670.

At block 660, the pointing device is adjusted to indicate the gun-tube orientation. The angular offset between the gun tube orientation and the pointing-device orientation may be used to align the pointing device to the gun-tube axis of the gun system. For a manual pointing device, aligning the pointing device to the gun-tube axis involves adjusting the pointing device such that the pointing device indicates the gun-tube orientation. The gun system is boresighted once the pointing device is adjusted to indicate the gun-tube orientation. After completing the procedures of block 660, the method 600 ends.

At block 670, offsets are determined between the gun-tube orientation and the pointing-device orientation. The offset between the gun tube orientation and the pointing-device orientation may be used to align the aiming subsystem (such as a pointing device) to the gun-tube axis of the gun system. The offset may comprise three angles that specify the pointing-device-to-gun-tube transform (or vice versa), such as three Euler angles. The offset may be determined by the boresight apparatus, the pointing device, or another device, such as an offset comparator.

At block 672, the offsets are provided to the pointing device. In the case of electronic pointing devices, the offsets are provided to and retained by the pointing device. The pointing device may calculate the gun-tube-to-pointing-device transform and/or the pointing-device-to-gun-tube transforms based on the offsets. Use of these transforms may allow the pointing device to change reference frames between the pointing-device frame-of-reference and the gun-tube frame-of-reference.

The gun system is boresighted once the offsets are provided to the pointing device. After completing the procedures of block 672, the method 600 ends.

An Example Method for Determining Pointing Accuracy of a Gun System

Figure 7:
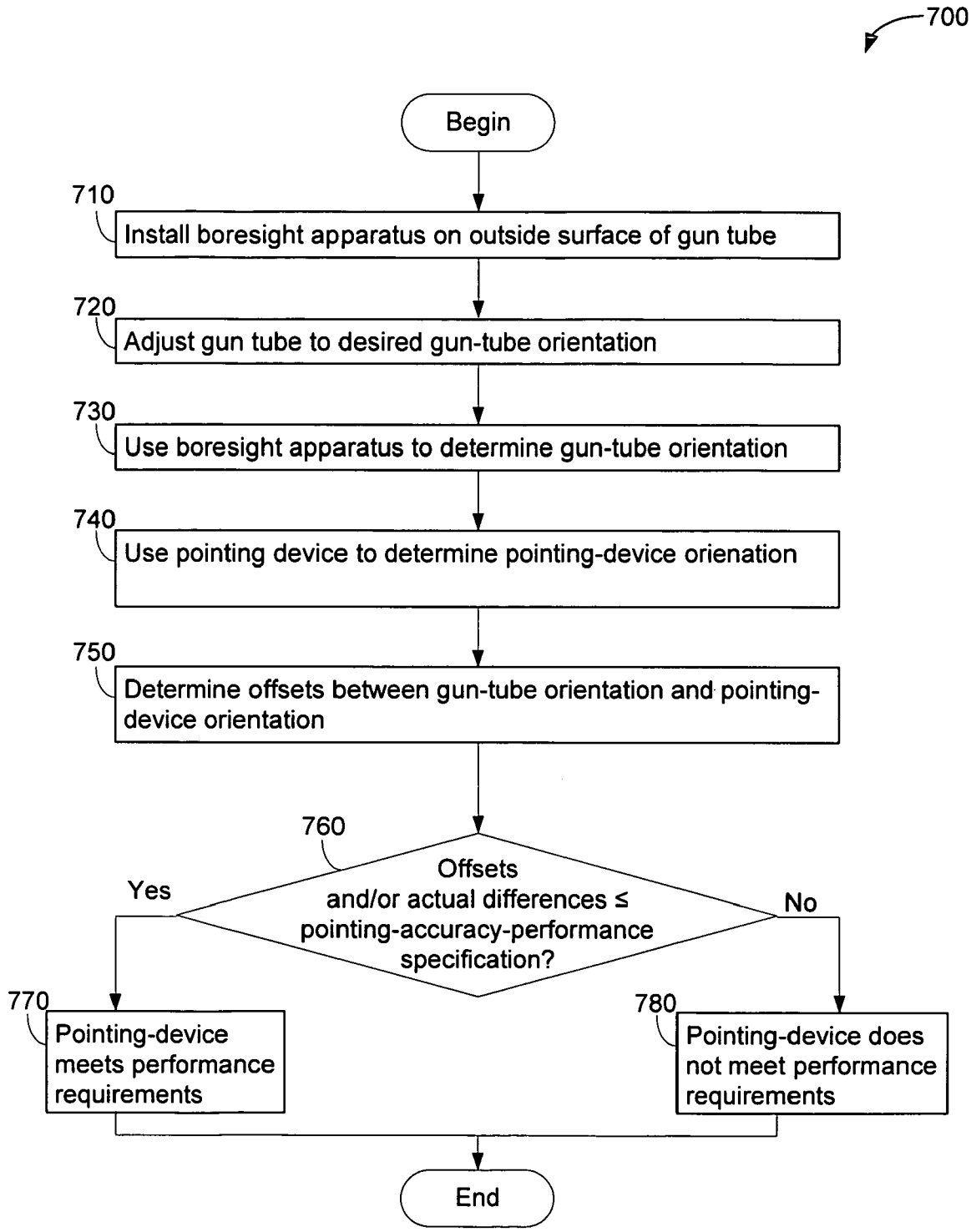
FIG. 7 is a flowchart of an example method for determining pointing accuracy of a gun system in accordance with embodiments of the invention.

FIG. 7 is a flowchart of an example method 700 for determining pointing accuracy of a gun system in accordance with embodiments of the invention. The gun system comprises a gun tube and a pointing device.

Method 700 begins at block 710, where a boresight apparatus may be installed on an outside surface of a gun tube, using the procedures described above for block 610 of FIG. 6.

At block 720, the gun tube may be adjusted to a desired gun-tube orientation, using the procedures described above for block 620 of FIG. 6.

At block 730, the boresight apparatus may be used to determine the gun-tube orientation, using the procedures described above for block 630 of FIG. 6.

At block 740, a pointing device may be used to determine a pointing-device orientation based on the gun-tube orientation using the procedures described above for block 640 of FIG. 6. The pointing device may be an electronic pointing device or a manual pointing device.

At block 750, offsets are determined between the gun-tube orientation and the pointing-device orientation using the procedures described above for block 670 of FIG. 6.

At block 760, the gun-tube orientation, the pointing-device orientation, and/or the offsets may be used to perform a comparison to a pointing-accuracy-performance specification. The offsets may be compared for one directional angle (e.g., the azimuth) and/or for all directional angles of the offsets. The offset comparison may include comparing an offset angular value to a performance-specification-threshold value and/or comparing each offset angular value to one or more performance-specification-threshold values.

The azimuth, elevation, and/or roll of the gun-tube orientation may be transformed from the gun-tube frame-of-reference into the pointing-device frame-of-reference using the offsets. Then, the azimuth, elevation, and/or roll of the gun-tube orientation, as transformed, may be compared to the azimuth, elevation, and/or roll respectively of the pointing-device orientation. The pointing-accuracy-performance specification may comprise one or more performance-specification-threshold values specifying a maximum difference between the directional angles of the gun-tube orientation and the pointing-device orientation. If so, the actual differences between the directional angles (azimuth, elevation, and/or roll) of the gun-tube orientation and the pointing-device orientation may be determined and compared to the performance-specification-threshold values specifying maximum differences between the directional angles of the gun-tube orientation and the pointing-device orientation.

If the compared offset angular values and/or actual differences are less than or equal to the corresponding performance-specification-threshold values, the method 700 may proceed to block 770. If the offset is greater than the corresponding performance-specification-threshold values, the method 700 may proceed to block 780.

At block 770, responsive to the offset angular values and/or the actual differences being less than or equal to the performance-specification-threshold values, a determination is made that the pointing accuracy of the gun system meets performance requirements.

After executing the procedures of block 770, method 700 ends.

At block 780, responsive to the offset angular values and/or the actual differences being greater than the performance-specification-threshold values, a determination is made that the pointing accuracy of the gun system does not meet its performance requirements. The gun system may be deemed inoperative and the cause of the failure may be determined and corrected. The gun system may be re-boresighted, either immediately or correcting any causes of failure. After executing the procedures of block 780, method 700 ends.

CONCLUSION

Exemplary embodiments of the present invention have been described above. Those skilled in the art will understand, however, that changes and modifications may be made to the embodiments described without departing from the true scope and spirit of the present invention, which is defined by the claims. It should be understood, however, that this and other arrangements described in detail herein are provided for purposes of example only and that the invention encompasses all modifications and enhancements within the scope and spirit of the following claims. As such, those skilled in the art will appreciate that other arrangements and other elements (e.g. machines, interfaces, functions, orders, and groupings of functions, etc.) can be used instead, and some elements may be omitted altogether.

Further, many of the elements described herein are functional entities that may be implemented as discrete or distributed components or in conjunction with other components, in any suitable combination and location, and as any suitable combination of hardware, firmware, and/or software.

The invention claimed is:

1. A boresight apparatus for a gun system, wherein the gun system comprises a gun tube comprising a gun-tube axis and a pointing device, the boresight apparatus comprising:

a mount configured to attach the boresight apparatus to an outside surface of the gun tube; and one or more angle-measurement devices attached to the mount and configured to determine at least one directional angle of the gun tube, wherein the mount is configured to align an axis of the boresight apparatus parallel to the gun-tube axis when the mount is placed on the outside surface of the gun tube, wherein the mount comprises a platform that includes two intersecting planes that rest tangential to the outside surface of the gun tube and are parallel to the gun-tube axis when the mount is placed on the outside surface of the gun tube.

2. The boresight apparatus of claim 1, wherein the directional angle is an azimuth of the gun tube.

3. The boresight apparatus of claim 1, wherein the directional angle is the elevation of the gun tube.

4. The boresight apparatus of claim 1, wherein the one or more angle-measurement devices utilizes an optical technology.

5. The boresight apparatus of claim 4, wherein the one or more angle-measurement devices comprises a laser, and wherein the mount is configured such that an optical axis of the laser is parallel to the gun-tube axis when the mount is placed on the outside surface of the gun tube.

6. The boresight apparatus of claim 1, wherein the boresight apparatus is configured to determine an offset between a gun-tube orientation and a pointing-device orientation, and wherein the gun-tube orientation is independent of the pointing-device orientation.

7. The boresight apparatus of claim 1, wherein the one or more angle-measurement devices comprises a gyroscope.

8. The boresight apparatus of claim 1, wherein the mount is configured to removably attach the boresight to the gun tube.

9. A method of boresighting a gun system, wherein the gun system comprises an electronic pointing system, a pointing device, and a gun tube comprising a gun-tube axis, the method comprising:

installing a boresight apparatus on an outside surface of the gun tube such that an axis of the boresight apparatus is aligned parallel with the gun-tube axis;

adjusting the gun tube to a desired gun-tube orientation;

determining a gun-tube orientation using the boresight apparatus; and boresighting the gun system based on the gun-tube orientation, wherein boresighting the gun system comprises:

determining a pointing-device orientation using the pointing device;

determining offsets between the gun-tube orientation and the pointing-device orientation; and providing the determined offsets to the pointing device.

10. The method of claim 9, wherein the pointing system is a manual pointing system.

11. The method of claim 9, wherein boresighting the gun system comprises adjusting the pointing device to indicate the gun-tube orientation.

12. The method of claim 9, wherein determining the gun-tube orientation using the boresight apparatus comprises determining an azimuth, an elevation, and a roll of the gun tube.

13. The method of claim 9, wherein installing the boresight apparatus comprises attaching a mount to the outside surface of the gun tube, wherein the mount comprises a platform that includes two intersecting planes that rest tangential to the outside surface of the gun tube and are parallel to the gun-tube axis when the mount is placed on the outside surface of the gun tube.

14. A boresight apparatus for a gun system, wherein the gun system comprises a gun tube comprising a gun-tube axis and a pointing device, the boresight apparatus comprising:

a mount configured to attach the boresight apparatus to an outside surface of the gun tube; and one or more angle-measurement devices attached to the mount and configured to determine at least one directional angle of the gun tube, wherein the mount is configured to align an axis of the boresight apparatus parallel to the gun-tube axis when the mount is placed on the outside surface of the gun tube, wherein the mount comprises a first cylinder and a second cylinder parallel to the first cylinder, wherein the first and second cylinders contact the gun tube when the mount is placed on the outside surface of the gun tube.

15. The boresight apparatus of claim 14, wherein the directional angle is an azimuth of the gun tube.

16. The boresight apparatus of claim 14, wherein the directional angle is the elevation of the gun tube.

17. The boresight apparatus of claim 14, wherein the one or more angle-measurement devices utilizes an optical technology.

18. The boresight apparatus of claim 17, wherein the one or more angle-measurement devices comprises a laser, and wherein the mount is configured such that an optical axis of the laser is parallel to the gun-tube axis when the mount is placed on the outside surface of the gun tube.

19. The boresight apparatus of claim 14, wherein the boresight apparatus is configured to determine an offset between a gun-tube orientation and a pointing-device orientation, and wherein the gun-tube orientation is independent of the pointing-device orientation.

20. The boresight apparatus of claim 14, wherein the one or more angle-measurement devices comprises a gyroscope.

21. The boresight apparatus of claim 14, wherein the mount is configured to removably attach the boresight to the gun tube.

* * * * *